US010837664B2

(12) United States Patent
Rice et al.

(10) Patent No.: US 10,837,664 B2
(45) Date of Patent: Nov. 17, 2020

(54) INDOOR VENTILATION EXHAUST SYSTEM

(71) Applicants: James Rice, Lacolle (CA); Kevin Chauvin, Lacolle (CA)

(72) Inventors: James Rice, Lacolle (CA); Kevin Chauvin, Lacolle (CA)

( * ) Notice: Subject to any disclaimer, the term of this patent is extended or adjusted under 35 U.S.C. 154(b) by 292 days.

(21) Appl. No.: 15/889,302

(22) Filed: Feb. 6, 2018

(65) Prior Publication Data

US 2019/0242600 A1 Aug. 8, 2019

(51) Int. Cl.

| | |
|---|---|
| ***F24F 7/10*** | (2006.01) |
| ***F24F 7/06*** | (2006.01) |
| ***F24F 7/00*** | (2006.01) |
| ***F24F 7/02*** | (2006.01) |

(52) U.S. Cl.

CPC ..... *F24F 7/10* (2013.01); *F24F 7/06* (2013.01); *F24F 7/025* (2013.01); *F24F 2007/001* (2013.01); *F24F 2007/002* (2013.01)

(58) Field of Classification Search

CPC ..... F24F 7/10; F24F 7/025; F24F 2007/002; F24F 2007/001; E04H 2001/1294

USPC ..... 454/354

See application file for complete search history.

(56) References Cited

U.S. PATENT DOCUMENTS

| | | | | |
|---|---|---|---|---|
| 5,181,883 | A | 1/1993 | Hofstra | |
| 5,306,207 | A * | 4/1994 | Courts | F24F 7/06 411/401 |
| 5,427,570 | A | 6/1995 | Chen | |
| 6,067,759 | A * | 5/2000 | House | E04D 13/0315 52/198 |
| 6,149,516 | A * | 11/2000 | Mantyla | F24F 7/007 454/349 |
| D487,505 | S | 3/2004 | Grobleben | |
| 7,147,553 | B2 | 12/2006 | Leask | |
| 9,212,517 | B1 | 12/2015 | Reid | |
| 2003/0129936 | A1 | 7/2003 | Shaikh | |
| 2009/0178687 | A1 | 7/2009 | Davis | |
| 2009/0253364 | A1* | 10/2009 | Henry | F24F 7/025 454/229 |
| 2015/0140921 | A1* | 5/2015 | Gonzalez | F24F 13/02 454/284 |
| 2015/0219358 | A1* | 8/2015 | Alfakhrany | F24F 7/06 454/256 |

* cited by examiner

*Primary Examiner* — Steven B McAllister
*Assistant Examiner* — Charles R Brawner

(57) ABSTRACT

The indoor ventilation exhaust system is configured for use in a domestic space. The indoor ventilation exhaust system is configured for use with second-hand smoke. The indoor ventilation exhaust system draws atmospheric gases containing second-hand smoke out of a domestic space. The indoor ventilation exhaust system comprises an manifold, discharge system, and a collection network. The discharge system attaches to the manifold. Each of one or more collection networks attach to the manifolds. The discharge system creates a partial vacuum that draws the second-hand smoke of out the domestic space into the collection network. The second-hand smoke is aggregated in the manifold and is then discharged from the domestic structure containing the domestic space through the discharge system. The discharge system creates the partial vacuum that transports the second-hand smoke.

9 Claims, 7 Drawing Sheets

INDOOR VENTILATION EXHAUST SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of heating and lighting including ventilation, more specifically, a ventilation system with forced air flow.

SUMMARY OF INVENTION

The indoor ventilation exhaust system is configured for use in a domestic space. The indoor ventilation exhaust system is configured for use with second-hand smoke. The indoor ventilation exhaust system draws atmospheric gases containing second-hand smoke out of a domestic space. The indoor ventilation exhaust system comprises a manifold, discharge system, and a collection network. The discharge system attaches to the manifold. Each of one or more collection networks attach to the manifolds. The discharge system creates a partial vacuum that draws the second-hand smoke of out the domestic space into the collection network. The second-hand smoke is aggregated in the manifold and is then discharged from the domestic structure containing the domestic space through the discharge system. The discharge system creates the partial vacuum that transports the second-hand smoke.

These together with additional objects, features and advantages of the indoor ventilation exhaust system will be readily apparent to those of ordinary skill in the art upon reading the following detailed description of the presently preferred, but nonetheless illustrative, embodiments when taken in conjunction with the accompanying drawings.

In this respect, before explaining the current embodiments of the indoor ventilation exhaust system in detail, it is to be understood that the indoor ventilation exhaust system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the indoor ventilation exhaust system.

It is therefore important that the claims be regarded as including such equivalent construction insofar as they do not depart from the spirit and scope of the indoor ventilation exhaust system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
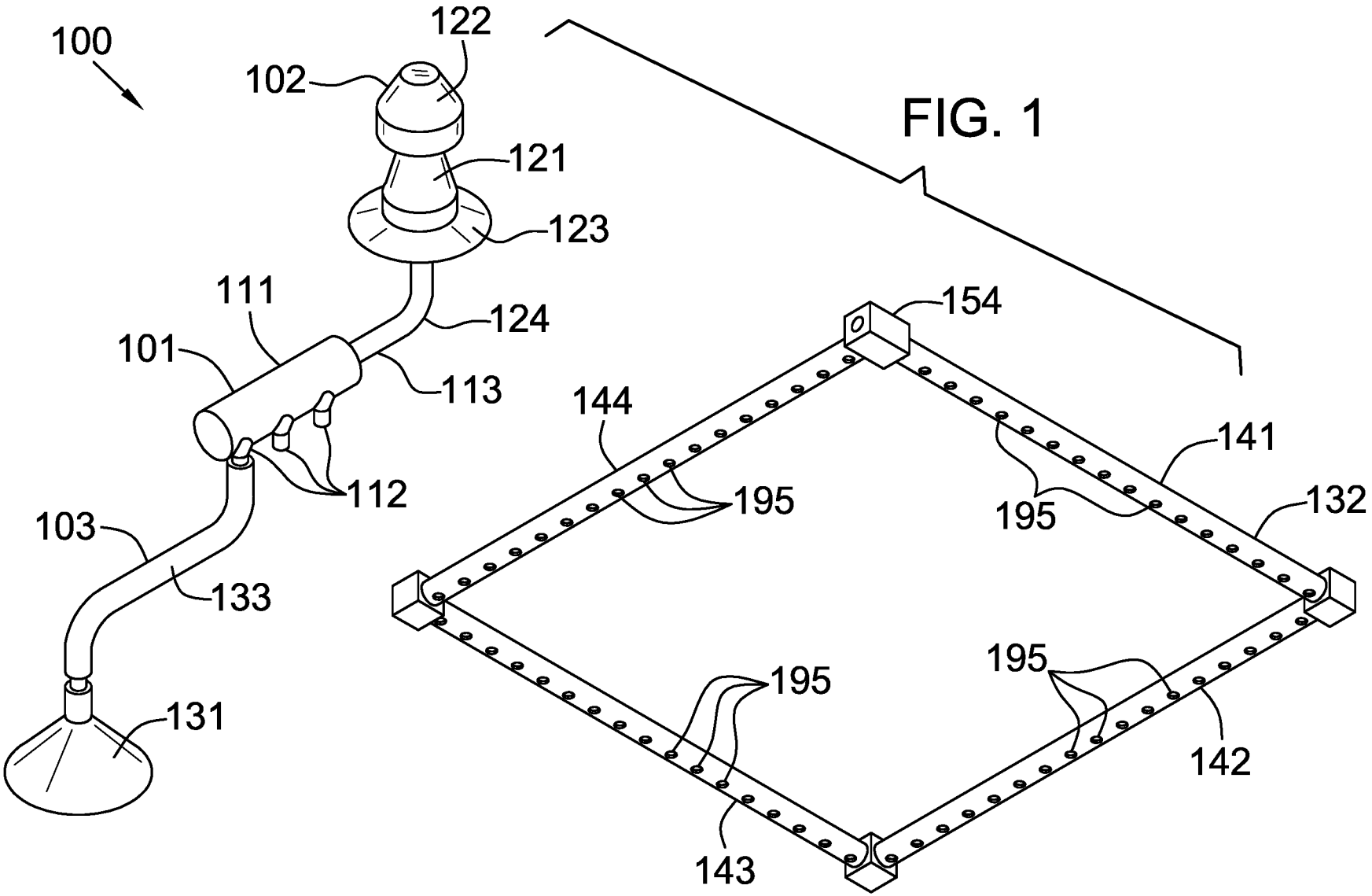
FIG. 1 is a perspective view of an embodiment of the disclosure.
Figure 2:
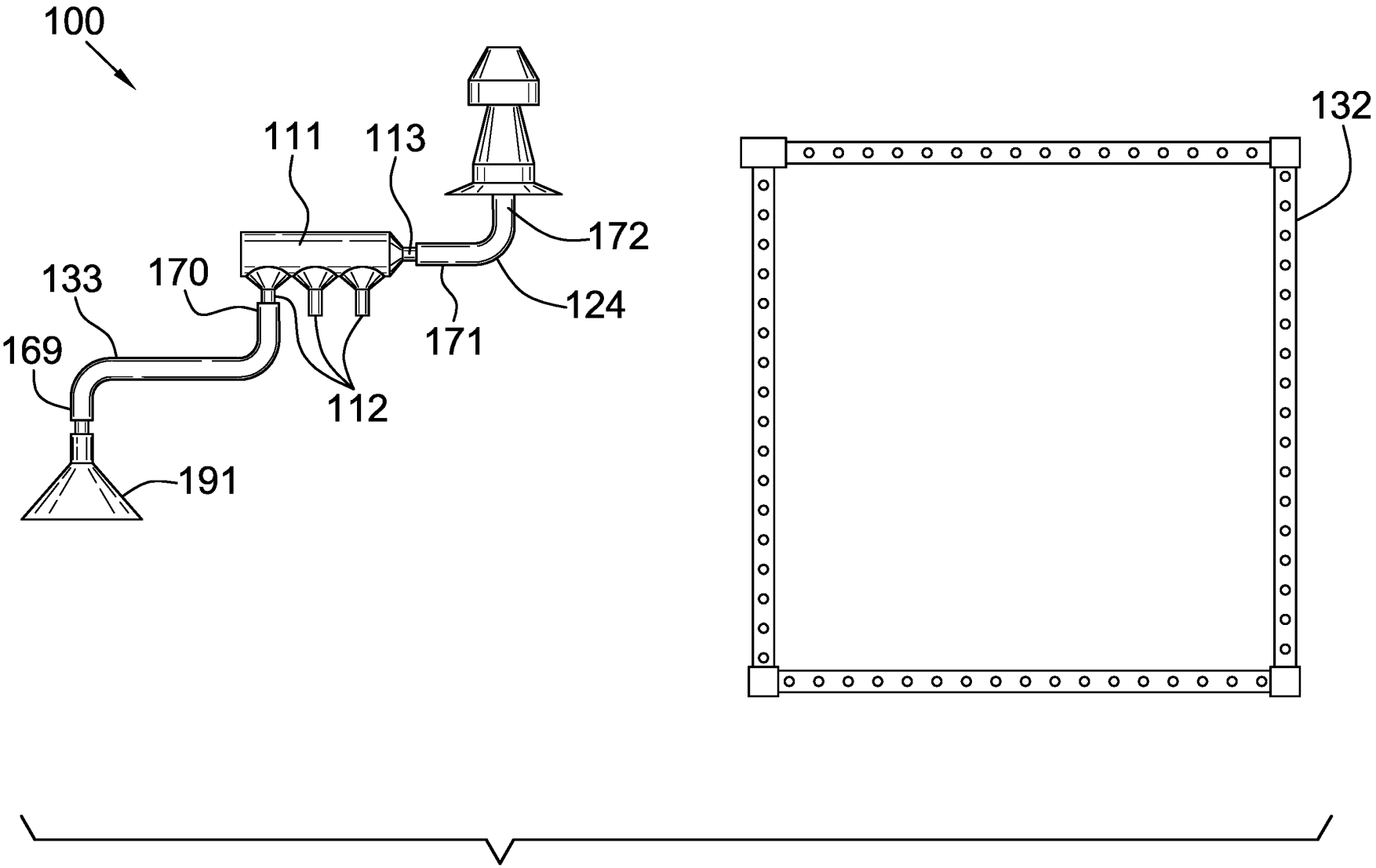
FIG. 2 is a front view of an embodiment of the disclosure.
Figure 3:
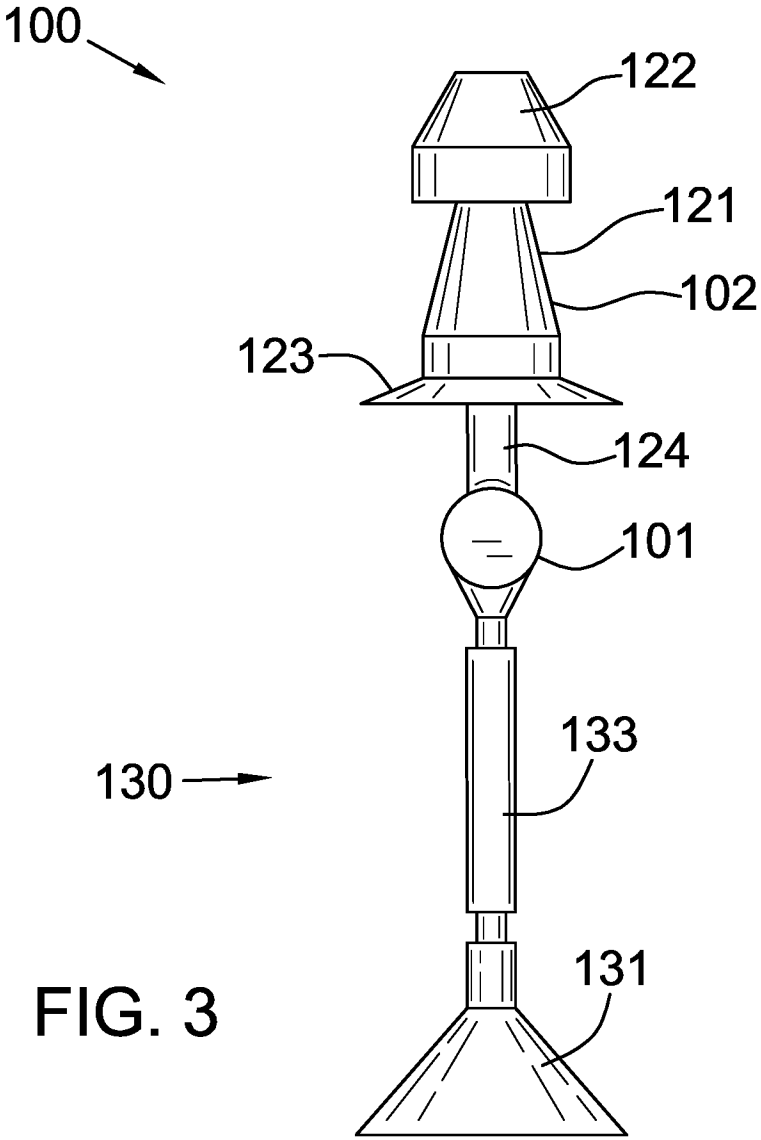
FIG. 3 is a side view of an embodiment of the disclosure.
Figure 4:
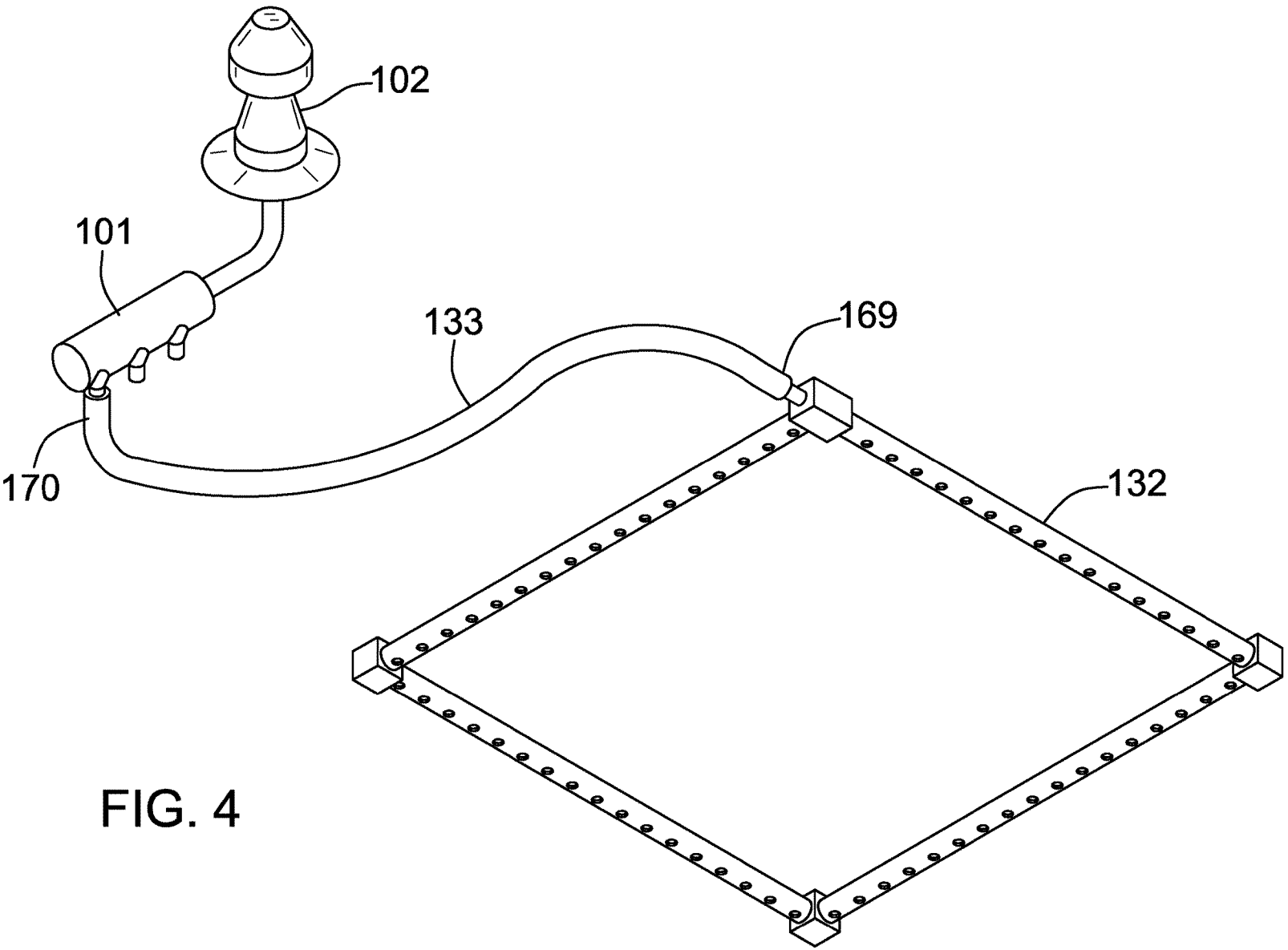
FIG. 4 is an assembled view of an embodiment of the disclosure.
Figure 5:
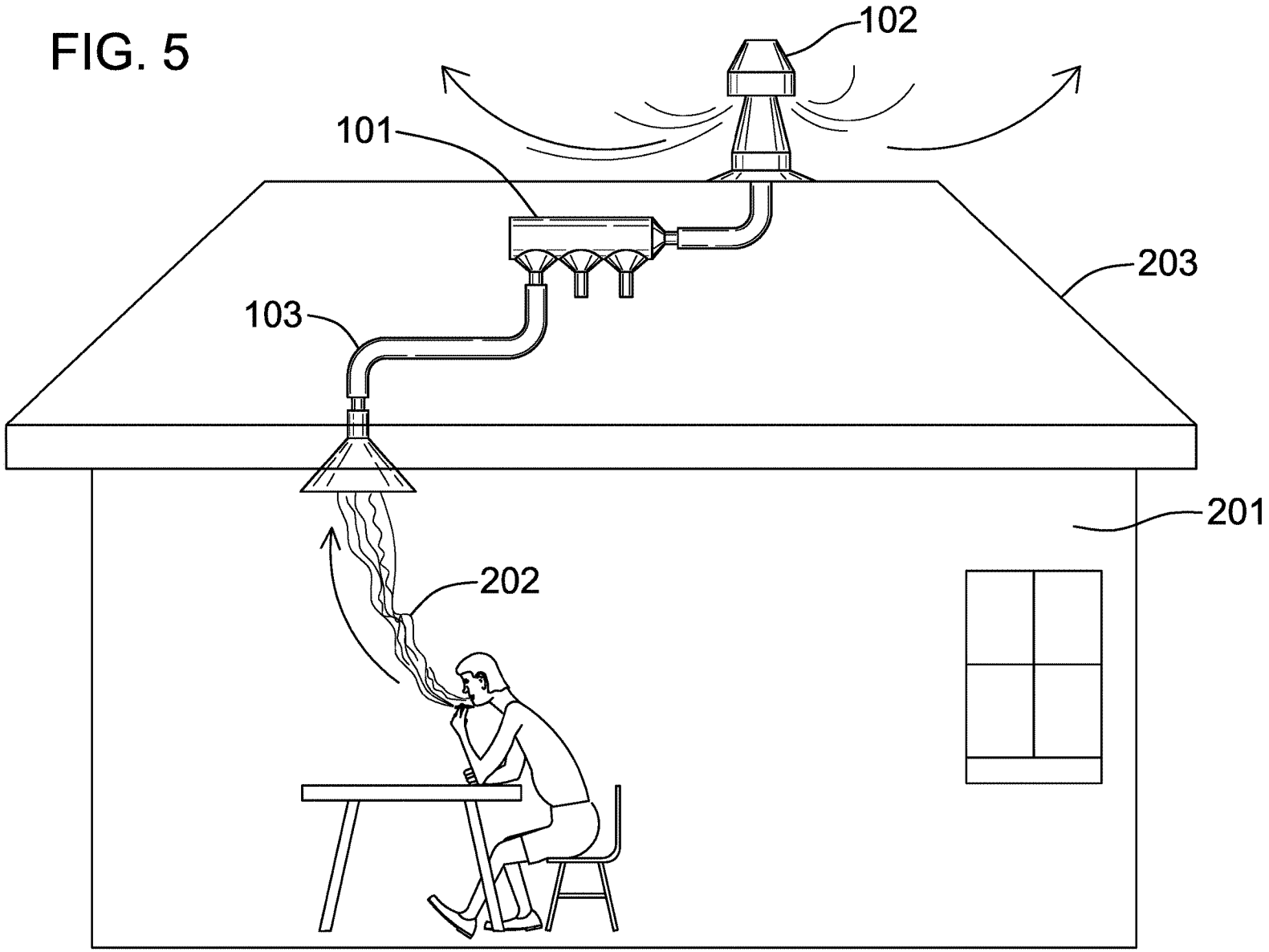
FIG. 5 is an in-use view of an embodiment of the disclosure.
Figure 6:
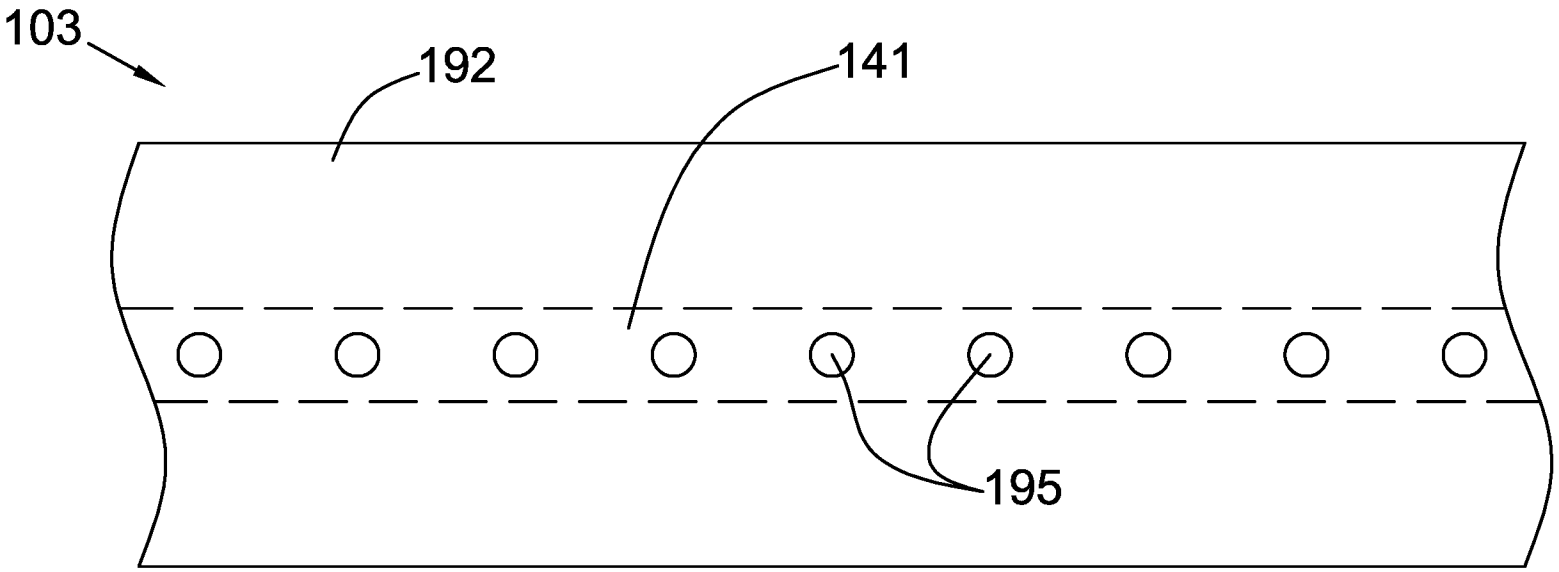
FIG. 6 is a detail view of an embodiment of the disclosure.
Figure 7:
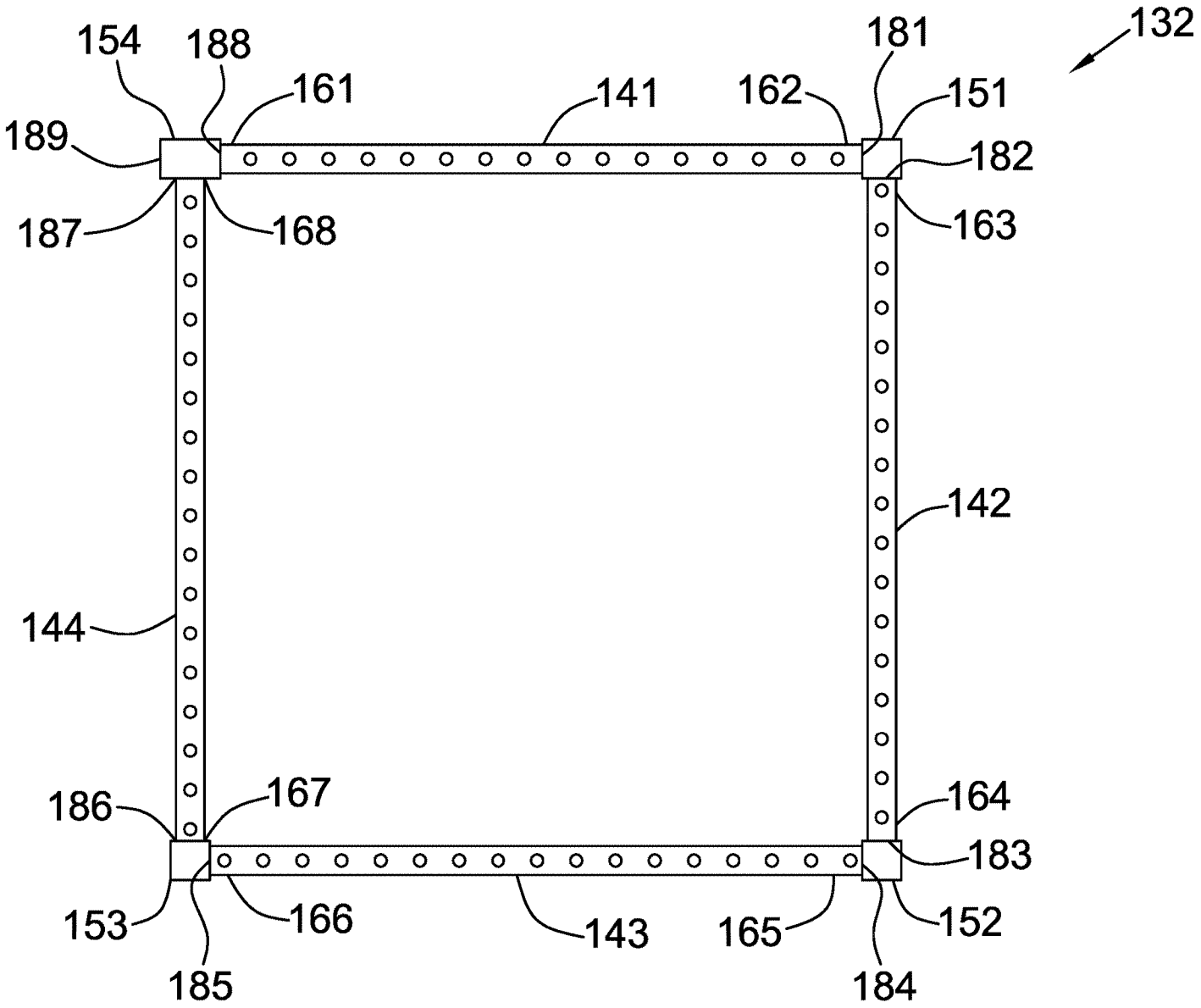
FIG. 7 is another detail view of an embodiment of the disclosure.

Detailed reference will now be made to one or more potential embodiments of the disclosure, which are illustrated in FIGS. 1 through 7.

The indoor ventilation exhaust system 100 (hereinafter invention) is configured for use in a domestic space 201. The invention 100 is configured for use with second-hand smoke 202. The invention 100 draws atmospheric gases containing second-hand smoke 202 out of a domestic space 201. The invention 100 comprises a manifold 101, discharge system 102, and a collection network 103. The discharge system 102 attaches to the manifold 101. The collection network 103 attaches to the manifold 101. The discharge system 102 creates a partial vacuum that draws the second-hand smoke 202 of out the domestic space 201 into the collection network 103. The second-hand smoke 202 is aggregated in the manifold 101 and is then discharged from the domestic structure 203 containing the domestic space 201 through the discharge system 102. The discharge system 102 creates the partial vacuum that transports the second-hand smoke 202.

The manifold 101 is a device that aggregates the second-hand smoke 202 from one or more collection nodes 130 into a single gas flow that is transported to the discharge system 102. The manifold 101 comprises a hollow cylinder 111, a plurality of intake fittings 112, and a discharge fitting 113.

The hollow cylinder 111 is a hollow prism-shaped pipe with two closed ends. This disclosure anticipates that the hollow cylinder 111 will mount in the roof of the domestic structure 203. The hollow cylinder 111 accumulates the second-hand smoke 202 drawn through the collection network 103 into a single chamber. The second-hand smoke 202 exits the hollow cylinder 111 through the discharge fitting 113 into the discharge hose 124 for expulsion from the domestic structure 203.

Each of the plurality of intake fittings 112 is a commercially available fitting that forms a port into the hollow cylinder 111. Each of the plurality of intake fittings 112 attaches to a transport hose 133 in order to receive the second-hand smoke 202 collected by the collection node 130 during the operation of the invention 100.

The discharge fitting 113 is a commercially available fitting that forms a port into the hollow cylinder 111. The discharge fitting 113 attaches to the discharge hose 124 such that the discharge hose 124 receives the accumulated second-hand smoke 202 within the hollow cylinder 111.

The discharge system 102 is a mechanical device. The discharge system 102 creates a pressure differential within the invention 100 that draws the second-hand smoke 202 from the collection network 103 through the manifold 101 and into the discharge system 102. This disclosure anticipates that the discharge system 102 will mount in the roof of the domestic structure 203. The discharge system 102 then pumps the second-hand smoke 202 out of the domestic structure 203 that contains the domestic space 201. The discharge system 102 comprises an exhaust fan 121, an exhaust vent 122, an exhaust valve 123, and a discharge hose 124. The discharge hose 124 is further defined with an eleventh end 171 and a twelfth end 172.

The exhaust fan 121 is a mechanical device that generates a pressure differential used for transporting the second-hand smoke 202 from the manifold 101 to the exhaust vent 122. The pressure differential created by the exhaust fan 121 provides the motive forces that move the second-hand smoke 202 through the invention 100. The exhaust fan 121 is a commercially available device.

The exhaust vent 122 is an aperture that expels the second-hand smoke 202 into the atmosphere. The exhaust valve 123 is a structure that attaches the exhaust fan 121 and the exhaust vent 122 to the domestic structure 203. The exhaust valve 123 is a sealed structure that prevents the second-hand smoke 202 from reentering the domestic structure 203 after discharge. The discharge hose 124 is a commercially available flexible tube that transports the second-hand smoke 202 from the manifold 101 to the exhaust fan 121.

The collection network 103 comprises a collection of one or more collection nodes 130. The collection network 103 is a foraminous structure that draws the second-hand smoke 202 out of the domestic space 201 into the invention 100. The collection node 130 mounts in the domestic space 201 containing the second-hand smoke 202. The collection node 130 comprises a mounting structure 131, an intake manifold 132, and the transport hose 133. The transport hose 133 is further defined with a ninth end 169 and a tenth end 170.

The collection node 130 is the node of the collection network 103 that draws the second-hand smoke 202 out of the domestic space 201 into the invention 100. The collection node 130 installs in the domestic space 201 of the domestic structure 203. It is preferred that the collection node 130 mounts near the ceiling of the collection node 130.

The mounting structure 131 is a structure that attaches the intake manifold 132 to an interior surface of the domestic space 201. The factors that determine the shape of the mounting structure 131 include, but are not limited to: 1) the characteristics of the domestic space 201; 2) desired flow characteristics of the second-hand smoke 202; and, 3) decorative characteristics desired from the collection node 130.

In the first potential embodiment of the disclosure, the mounting structure 131 is selected from the group consisting of a hood 191 and a crown molding 192. The hood 191 is a canopy that partially encloses the intake manifold 132. The design of the hood 191 accumulates the second-hand smoke 202 near the intake manifold 132 in preparation for elimination. The crown molding 192 is a molding that attaches to a vertical boundary surface of the domestic space 201. The position of the crown molding 192 is such that a foraminous pipe selected from the group consisting of the first foraminous pipe 141, the second foraminous pipe 142, the third foraminous pipe 143, and the fourth foraminous pipe 144 sits between the crown molding 192 and the vertical boundary surface of the domestic space 201. As shown most clearly in FIG. 6, the crown molding 192 has a foraminous structure that allows for the free flow of gas between the domestic space 201 and the selected foraminous pipe.

The transport hose 133 is a commercially available flexible tube that transports the domestic structure 203 from the intake manifold 132 to a fitting selected from the plurality of intake fittings 112.

The intake manifold 132 is a foraminous structure. The second-hand smoke 202 is drawn into the collection node 130 through the intake manifold 132. The intake manifold 132 comprises a first foraminous pipe 141, a second foraminous pipe 142, a third foraminous pipe 143, a fourth foraminous pipe 144, a first 90-degree elbow 151, a second 90-degree elbow 152, a third 90-degree elbow 153, and a tee connector 154.

The first foraminous pipe 141 is further defined with a first end 161 and a second end 162. The second foraminous pipe 142 is further defined with a third end 163 and a fourth end 164. The third foraminous pipe 143 is further defined with a fifth end 165 and a sixth end 166. The fourth foraminous pipe 144 is further defined with a seventh end 167 and an eight end 168. The first 90-degree elbow 151 is further defined with a first port 181 and a second port 182. The second 90-degree elbow 152 is further defined with a third port 183 and a fourth port 184. The third 90-degree elbow 153 is further defined with a fifth port 185 and a sixth port 186. The tee connector 154 is further defined with a seventh port 187, an eighth port 188, and a ninth port 189.

The first foraminous pipe 141 is a commercially available prism-shaped pipe. The first foraminous pipe 141 is formed with a foraminous surface that allows for the free flow of gas through the lateral face of the first foraminous pipe 141. A first subset of apertures selected from a plurality of apertures 195 form the foraminous surface of the first foraminous pipe 141. The second-hand smoke 202 is drawn into the first foraminous pipe 141 for transport into the transport hose 133 through this first subset of apertures.

The second foraminous pipe 142 is a commercially available prism-shaped pipe. The second foraminous pipe 142 is formed with a foraminous surface that allows for the free flow of gas through the lateral face of the second foraminous pipe 142. A second subset of apertures selected from the plurality of apertures 195 form the foraminous surface of the second foraminous pipe 142. The second-hand smoke 202 is drawn into second foraminous pipe 142 for transport into the transport hose 133 through this second subset of apertures.

The third foraminous pipe 143 is a commercially available prism-shaped pipe. The third foraminous pipe 143 is formed with a foraminous surface that allows for the free flow of gas through the lateral face of the third foraminous pipe 143. A third subset of apertures selected from the plurality of apertures 195 form the foraminous surface of the third foraminous pipe 143. The second-hand smoke 202 is drawn into the third foraminous pipe 143 for transport into the transport hose 133 through this third subset of apertures.

The fourth foraminous pipe 144 is a commercially available prism-shaped pipe. The fourth foraminous pipe 144 is formed with a foraminous surface that allows for the free flow of gas through the lateral face of the fourth foraminous pipe 144. A fourth subset of apertures selected from the plurality of apertures 195 form the foraminous surface of the fourth foraminous pipe 144. The second-hand smoke 202 is drawn into the fourth foraminous pipe 144 for transport into the transport hose 133 through this fourth subset of apertures.

The first 90-degree elbow 151 is a commercially available plumbing fitting. The first 90-degree elbow 151 attaches the first foraminous pipe 141 to the second foraminous pipe 142 to form a fluidic connection. The second 90-degree elbow 152 is a commercially available plumbing fitting. The second 90-degree elbow 152 attaches the second foraminous pipe 142 to the third foraminous pipe 143 to form a fluidic connection. The third 90-degree elbow 153 is a commercially available plumbing fitting. The third 90-degree elbow 153 attaches the third foraminous pipe 143 to the fourth foraminous pipe 144 to form a fluidic connection. The tee connector 154 is a commercially available plumbing fitting. The tee connector 154 attaches the fourth foraminous pipe 144 to the first foraminous pipe 141 to form a fluidic connection.

This paragraph describes the general assembly of the invention 100. The intake manifold 132 attaches to the mounting structure 131. The transport hose 133 attaches the intake manifold 132 to a plurality of intake fittings 112 of the manifold 101. The discharge hose 124 attaches the discharge fitting 113 of the manifold 101 to the exhaust fan 121 of the discharge system 102. The exhaust vent 122 attaches to the exhaust fan 121 such that the second-hand smoke 202 is pumped through the exhaust vent 122 to the exterior of the domestic structure 203 that contains the domestic space 201. The exhaust valve 123 attaches the exhaust fan 121 to the domestic structure 203. The exhaust valve 123 forms a seal such that the second-hand smoke 202 will not leak into the domestic structure 203 through the discharge system 102.

The following two paragraphs describe the operation of the invention 100.

The exhaust fan 121 is configured to draw second-hand smoke 202 through the discharge hose 124 from the discharge fitting 113 of the manifold 101 into the exhaust fan 121. The exhaust fan 121 discharges the second-hand smoke 202 into the atmosphere outside of the domestic structure 203 through the exhaust vent 122. The exhaust fan 121 creates a partial vacuum large enough such that the partial vacuum draws the second-hand smoke 202 through the collection node 130 connected to an intake fitting selected from the plurality of intake fittings 112 of the manifold 101.

The transport hose 133 of each collection node 130 transports the second-hand smoke 202 to an intake fitting selected from the plurality of intake fittings 112. The second-hand smoke 202 is drawn into the transport hose 133 through the plurality of apertures 195 formed in the intake manifold 132. The pressure differential created by the exhaust fan 121 creates the forces necessary to draw the second-hand smoke 202 into and through the invention 100.

The following three paragraphs describe the assembly of the intake manifold 132.

The second end 162 of the first foraminous pipe 141 inserts into the first port 181 of the first 90-degree elbow 151. The third end 163 of the second foraminous pipe 142 inserts into the second port 182 of the first 90-degree elbow 151. The fourth end 164 of the second foraminous pipe 142 inserts into the third port 183 of the second 90-degree elbow 152. The fifth end 165 of the third foraminous pipe 143 inserts into the fourth port 184 of the second 90-degree elbow 152.

The sixth end 166 of the third foraminous pipe 143 inserts into the fifth port 185 of the third 90-degree elbow 153. The seventh end 167 of the fourth foraminous pipe 144 inserts into the sixth port 186 of the third 90-degree elbow 153. The eighth end 168 of the fourth foraminous pipe 144 inserts into the seventh port 187 of the tee connector 154. The first end 161 of the first foraminous pipe 141 inserts into the eighth port 188 of the tee connector 154.

The ninth end 169 of the transport hose 133 attaches to the ninth port 189 of the tee connector 154. The tenth end 170 of the transport hose 133 attaches to an intake fitting selected from the plurality of intake fittings 112. The eleventh end 171 of the discharge hose 124 attaches to an intake fitting selected from the discharge fitting 113 of the manifold 101. The twelfth end 172 of the discharge hose 124 attaches to the intake of the exhaust fan 121.

The following definitions were used in this disclosure:

90-degree Elbow: As used in this disclosure, a 90-degree elbow is a two-aperture fitting that attaches a first pipe to a second pipe such that the center axis of the first pipe is perpendicular to the center axis of the second pipe.

Atmosphere: As used in this disclosure, the atmosphere refers to a blanket of gases (primarily nitrogen and oxygen) that surround the earth. Typical atmospheric conditions are approximated and characterized by the normal temperature and pressure.

Canopy: As used in this disclosure, a canopy is a cover that is placed above a space to create a protected area.

Ceiling: As used in this disclosure a ceiling refers to either: 1) the superior horizontal surface of a room that is distal from the floor; 2) the superior horizontal surface of a structure; or, 3) the upper limit of a range. A floor and a ceiling can refer to the same structure wherein the selection depends solely on the point of view of the user. The selection of this definition depends on the context. In situations where the context is unclear the first definition should be used.

Fan: As used in this disclosure, a fan is a pump that moves a gas.

Fitting: As used in this disclosure, a fitting is a component that is attached to a first object. The fitting is used to form a fluidic connection between the first object and a second object.

Fluid: As used in this disclosure, a fluid refers to a state of matter wherein the matter is capable of flow and takes the shape of a container it is placed within. The term fluid commonly refers to a liquid or a gas.

Foraminous: As used in this disclosure, foraminous is an adjective that describes a surface, plate, or platform that is perforated with a plurality of holes.

Gas: As used in this disclosure, a gas refers to a state (phase) of matter that is fluid and that fills the volume of the structure that contains it. Stated differently, the volume of a gas always equals the volume of its container.

Hood: As used in this disclosure, a hood is a canopy dedicated to removing gas from a space.

Hose: As used in this disclosure, a hose is a flexible hollow cylindrical device that is used for transporting liquids and gases. When referring to a hose in this disclosure, the terms inner diameter and outer diameter are used as they would be used by those skilled in the plumbing arts.

Manifold: As used in this disclosure, a manifold is a pipe or chamber having several ports through which liquid or gas is gathered or distributed.

Pharmacologically Active Media: As used in this disclosure, a pharmacologically active media refers to a chemical substance that has a biochemical or physiological effect on a biological organism.

Pipe: As used in this disclosure, a pipe is a hollow prism-shaped device used for transporting a fluid. The line that connects the center of the first base of the prism to the center of the second base of the prism is referred to as the axis of the prism or the centerline of the pipe. When two pipes share the same centerline they are said to be aligned. In this disclosure, the terms inner dimension of a pipe and outer dimension are used as they would be used by those skilled in the plumbing arts.

Port: As used in this disclosure, a port is an opening formed in an object that allows fluid to flow through the boundary of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Second-Hand Smoke: As used in this disclosure, second-hand smoke refers to the gas phase of the products of a combustion reaction involving a pharmacologically active media.

Tee Connector: As used in this disclosure, a T Connector is a three aperture fitting that is designed to connect a first pipe, a second pipe and a third pipe such that: 1) the center axis of the first pipe is aligned with the center axis of the second pipe; 2) the center axis of the third pipe is perpendicular to the aligned center axes of the first pipe and the second pipe; and, 3) the center axes of the first pipe, the second pipe, and the third pipe intersect at a single point. The tee connector is a commercially available plumbing and PVC pipe fitting.

Vacuum: As used in this disclosure, the term vacuum is used to describe a first space that contains gas at a reduced gas pressure relative to the gas pressure of a second space. If the first space and the second space are connected, this pressure differential will cause gas from the second space to move towards the first space until the pressure differential is eliminated.

Vent: As used in this disclosure, a vent is an opening in a structure that allows for the flow of gas through the boundary of the structure.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A forced air ventilation system comprising:

a manifold, a discharge system, and a collection network;

wherein the discharge system attaches to the manifold;

wherein the collection network attaches to the manifold;

wherein the forced air ventilation system is configured for use in a domestic space;

wherein the forced air ventilation system is configured for use with second-hand smoke;

wherein the forced air ventilation system draws the second-hand smoke out of a domestic space;

wherein the second-hand smoke is transported through the manifold;

wherein the second-hand smoke is discharged from a domestic structure containing the domestic space by the discharge system;

wherein the discharge system creates a partial vacuum that draws the second-hand smoke of out the domestic space into the collection network;

wherein the discharge system comprises an exhaust fan, an exhaust vent, and a discharge hose;

wherein the exhaust fan, the exhaust vent, and the discharge hose are fluidically interconnected;

wherein the exhaust fan is a mechanical device;

wherein the exhaust fan generates a pressure differential wherein the exhaust vent is an aperture;

wherein the exhaust vent expels the second-hand smoke into the atmosphere;

wherein the discharge hose is a flexible tube;

wherein the discharge hose transports the second-hand smoke from the manifold to the exhaust fan;

wherein the discharge system creates a partial vacuum;

wherein the manifold aggregates the second-hand smoke from the collection network into a single gas flow;

wherein the discharge system pumps the second-hand smoke out of the domestic structure that contains the domestic space;

wherein the collection network comprises one or more collection nodes;

wherein the collection network draws the second-hand smoke out of the domestic space into the forced air ventilation system;

wherein the collection node mounts in the domestic space;

wherein the manifold comprises a hollow cylinder, a plurality of intake fittings, and a discharge fitting;

wherein the plurality of intake fittings and the discharge fitting attach to the hollow cylinder;

wherein the hollow cylinder accumulates the second-hand smoke drawn through the collection network into a single chamber;

wherein the second-hand smoke exits the hollow cylinder through the discharge fitting into the discharge system;

wherein each of the plurality of intake fittings forms a port into the hollow cylinder;

wherein each of the plurality of intake fittings attaches the collection network;

wherein the discharge fitting forms a port into the hollow cylinder;

wherein the discharge system is a mechanical device;

wherein the discharge system creates a pressure differential within the forced air ventilation system;

wherein the discharge system creates a pressure differential to draw the second-hand smoke from the collection network through the manifold and into the discharge system;

wherein the collection node comprises an intake manifold, and the transport hose;

wherein the transport hose forms a fluidic connection between the intake manifold and an intake fitting selected from the plurality of intake fittings;

wherein the intake manifold comprises a first foraminous pipe, a second foraminous pipe, a third foraminous pipe, a fourth foraminous pipe, a first 90-degree elbow, a second 90-degree elbow, a third 90-degree elbow, and a tee connector;

wherein the first foraminous pipe is further defined with a first end and a second end;

wherein the second foraminous pipe is further defined with a third end and a fourth end;

wherein the third foraminous pipe is further defined with a fifth end and a sixth end;

wherein the fourth foraminous pipe is further defined with a seventh end and an eighth end;

wherein the first 90-degree elbow is further defined with a first port and a second port;

wherein the second 90-degree elbow is further defined with a third port and a fourth port;

wherein the third 90-degree elbow is further defined with a fifth port and a sixth port;

wherein the tee connector is further defined with a seventh port, an eighth port, and a ninth port;

wherein the transport hose is further defined with a ninth end and a tenth end;

wherein the discharge hose is further defined with an eleventh end and a twelfth end.

2. The forced air ventilation system according to claim 1 wherein the intake manifold is a foraminous structure;

wherein the second-hand smoke is drawn into the collection node through the intake manifold.

3. The forced air ventilation system according to claim 2 wherein the first foraminous pipe, the second foraminous pipe, the third foraminous pipe, the fourth foraminous pipe, the first 90-degree elbow, the second 90-degree elbow, the third 90-degree elbow, and the tee connector are fluidically interconnected.

4. The forced air ventilation system according to claim 3 wherein the first foraminous pipe is a prism-shaped pipe;

wherein the second foraminous pipe is a prism-shaped pipe;

wherein the third foraminous pipe is a prism-shaped pipe;

wherein the fourth foraminous pipe is a commercially available prism-shaped pipe;

wherein the first 90-degree elbow is a plumbing fitting;

wherein the second 90-degree elbow is a plumbing fitting;

wherein the third 90-degree elbow is a plumbing fitting;

wherein the tee connector is a plumbing fitting.

5. The forced air ventilation system according to claim 4 wherein the first foraminous pipe is formed with a foraminous surface that allows for the free flow of gas through a lateral face of the first foraminous pipe;

wherein the second foraminous pipe is formed with a foraminous surface that allows for the free flow of gas through a lateral face of the second foraminous pipe;

wherein the third foraminous pipe is formed with a foraminous surface that allows for the free flow of gas through a lateral face of the third foraminous pipe;

wherein the fourth foraminous pipe is formed with a foraminous surface that allows for the free flow of gas through a lateral face of the fourth foraminous pipe.

6. The forced air ventilation system according to claim 5 wherein the first 90-degree elbow attaches the first foraminous pipe to the second foraminous pipe to form a fluidic connection;

wherein the second 90-degree elbow attaches the second foraminous pipe to the third foraminous pipe to form a fluidic connection;

wherein the third 90-degree elbow attaches the third foraminous pipe to the fourth foraminous pipe to form a fluidic connection;

wherein the tee connector attaches the fourth foraminous pipe to the first foraminous pipe to form a fluidic connection.

7. The forced air ventilation system according to claim 6 wherein the discharge hose attaches the discharge fitting of the manifold to the exhaust fan of the discharge system;

wherein the exhaust vent attaches to the exhaust fan such that the second-hand smoke is pumped through the exhaust vent to the exterior of the domestic structure that contains the domestic space.

8. The forced air ventilation system according to claim 7 wherein the second end of the first foraminous pipe inserts into the first port of the first 90-degree elbow;

wherein the third end of the second foraminous pipe inserts into the second port of the first 90-degree elbow;

wherein the fourth end of the second foraminous pipe inserts into the third port of the second 90-degree elbow;

wherein the fifth end of the third foraminous pipe inserts into the fourth port of the second 90-degree elbow;

wherein the sixth end of the third foraminous pipe inserts into the fifth port of the third 90-degree elbow;

wherein the seventh end of the fourth foraminous pipe inserts into the sixth port of the third 90-degree elbow;

wherein the eighth end of the fourth foraminous pipe inserts into the seventh port of the tee connector;

wherein the first end of the first foraminous pipe inserts into the eighth port of the tee connector.

9. The forced air ventilation system according to claim 8 wherein the ninth end of the transport hose attaches to the ninth port of the tee connector;

wherein the tenth end of the transport hose attaches to an intake fitting selected from the plurality of intake fittings;

wherein the eleventh end of the discharge hose attaches to an intake fitting from the discharge fitting of the manifold;

wherein the twelfth end of the discharge hose attaches to the intake of the exhaust fan.

* * * * *